US009206801B2

(12) United States Patent
Sharma et al.

(10) Patent No.: US 9,206,801 B2
(45) Date of Patent: Dec. 8, 2015

(54) ROTARY THREE DIMENSIONAL VARIABLE VOLUME MACHINE

(71) Applicants: Arvind Kumar Sharma, Gwalior Madhya Pradesh (IN); Arvind Kumar Singh, Gwalior Madhya Pradesh (IN)

(72) Inventors: Arvind Kumar Sharma, Gwalior Madhya Pradesh (IN); Arvind Kumar Singh, Gwalior Madhya Pradesh (IN)

( * ) Notice: Subject to any disclaimer, the term of this patent is extended or adjusted under 35 U.S.C. 154(b) by 153 days.

(21) Appl. No.: 13/868,237

(22) Filed: Apr. 23, 2013

(65) Prior Publication Data

US 2014/0076155 A1 Mar. 20, 2014

(30) Foreign Application Priority Data

Oct. 25, 2010 (IN) ..... 2966/MUM/2010A
Aug. 30, 2011 (WO) ..... PCT/IN2011/000596

(51) Int. Cl.

| | |
|---|---|
| ***F04C 2/36*** | (2006.01) |
| ***F04C 2/26*** | (2006.01) |
| ***F01C 1/20*** | (2006.01) |
| ***F01C 1/00*** | (2006.01) |
| ***F04C 2/00*** | (2006.01) |

(52) U.S. Cl.

CPC ... *F04C 2/26* (2013.01); *F01C 1/00* (2013.01); *F01C 1/20* (2013.01); *F04C 2/00* (2013.01); *F04C 2/36* (2013.01)

(58) Field of Classification Search

CPC ..... F04C 2/102; F04C 2/107; F04C 2/113; F04C 2/22; F04C 2/04; F04C 2/045; F04C 2/067; F04C 2/26; F04C 2/36; F04C 18/04; F04C 18/06; F04C 18/063; F04C 18/067; F01C 1/18; F01C 1/20; F01C 1/26; F01C 1/36

USPC ..... 418/55.1, 58, 59, 61.1, 64, 107, 191, 9, 418/196

See application file for complete search history.

(56) References Cited

U.S. PATENT DOCUMENTS

| | | | | |
|---|---|---|---|---|
| 675,353 | A * | 5/1901 | Hoffman | F04C 2/14 418/183 |
| 1,059,637 | A * | 4/1913 | Recen | 418/191 |
| 1,261,927 | A | 4/1918 | Harvey | |
| 3,447,471 | A | 6/1969 | Cyphelly | |
| 3,551,082 | A | 12/1970 | Zimmerman | |

FOREIGN PATENT DOCUMENTS

| | | |
|---|---|---|
| GB | 07441 | 0/1910 |

* cited by examiner

*Primary Examiner* — Thomas Denion
*Assistant Examiner* — Laert Dounis
(74) *Attorney, Agent, or Firm* — Dominic A. Frisina

(57) ABSTRACT

An embodiment may have two rotary discs including a second disc (a cap) and a first disc; and a rotary 'cam' (having ports) placed in the central hole of the first disc. A cap is half the diameter of the first disc. Both face each other and maintain contour complementarity during both of two modes of operation The cap seals the cavity underneath, and without jeopardizing the sealing, permits entry and exit of the radial ridges and furrows of the first disc into it. The ridges sweep the floor (under surface) of the cap and divide the cavity into variable volume compartments that suck and expel fluid simultaneously through the 'cam'. The machine is designed to work as rotary pump, compressor, turbine or internal combustion engine.

2 Claims, 15 Drawing Sheets

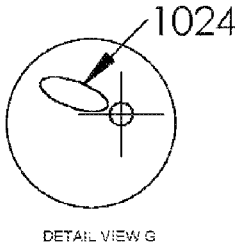
FIG. 10
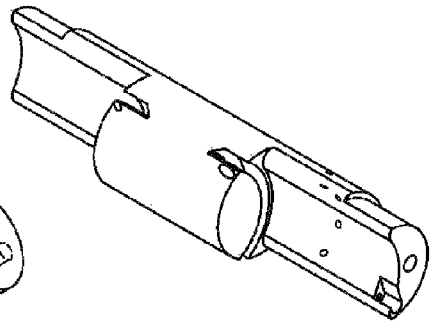
FIG. 11A
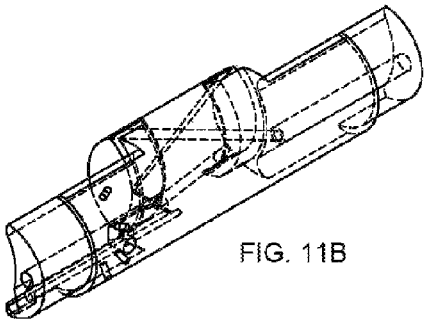
FIG. 11B
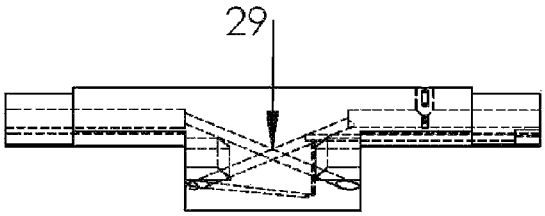
FIG. 11C
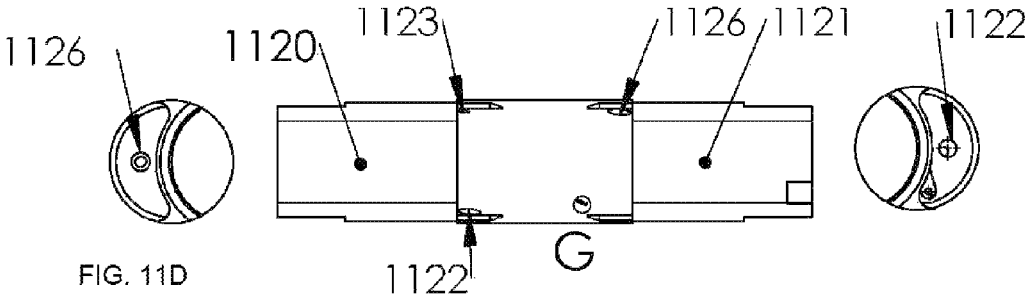
FIG. 11D
FIG. 11E
FIG. 11F

ROTARY THREE DIMENSIONAL VARIABLE VOLUME MACHINE

I. RELATED APPLICATIONS

This is a Continuation-in-Part application of International Patent Application No. PCT/IN2011/000596 having an international filing date of Aug. 30, 2011, which claims priority to Indian Patent Application No. 2966/MUM/2010A filed on Oct. 25, 2010. Each of these related applications are incorporated herein by reference in their entireties.

II. BACKGROUND OF THE INVENTION

A. Field of Invention

The invention relates to a rotary machine that is capable of varying the space enclosed between the discs in all the three dimensions, and having inlet and outlet ports for transfer of fluid from and to the surroundings of the machine.

B. Description of the Related Art

There are basically two kinds of machine systems, the rotary ones and the reciprocatory ones. The rotary ones generally use continuous centrifugal force to do the work (displacement or compression of fluids etc.) as done by centrifugal pumps, compressors, and turbines; whereas, the reciprocatory systems use positive displacement mechanism to do the same kind of work, but they do so batch wise and discontinuously (first take in and then expel out fluid from the compartment) by reciprocation of piston in the cylinder.

These two kinds of machine systems have dissimilar and rather opposite functional properties. That is to say, centrifugal systems though continuous and rotary, lack good torque at low rpm; whereas, the reciprocatory systems though have good torque at small speeds are discontinuous and reciprocatory, and so the vibrations generated hinder the functioning at higher speeds.

This invention combines the better of the two, and relates to a rotary system that by using positive displacement mechanism, increases and decreases the volume of the enclosed space in all the three dimensions, continuously and simultaneously in the two adjoining compartments formed by the entry and exit of the ridges into the cavity; and if the whole cavity is considered as one, the variation in volume occurs alternately. The machine can be modified suitably to put to at least four different uses, that is, a pump, a compressor, a turbine, or a rotary internal combustion engine.

Some embodiments of the present invention may provide one or more benefits or advantages over the prior art.

III. SUMMARY OF THE INVENTION

This machine has essentially two discs (apart from other supporting parts); not considering the wall thickness, one being half the diameter the other, and both having contour complementarity in the third dimension, such that the compartments in the cavity are formed between the faces pressed together, such that the enclosed space changes volume in all the three dimensions continuously, simultaneously and alternately either when both the discs rotate together, or when the smaller one rotates as well as revolves pressed the face of the larger one when the larger one remains stationary.

Continuously, as the volume increases in one compartment, suction or intake results through the suction port; and simultaneously, in the adjoining compartment as the volume decreases, compression or exhaust results through exhaust port; though, both the operations occur alternately in the same cavity.

The process continues as long as the discs are in motion. Thus, while the basic principle is essentially the same, this machine can be designed to put to, at least four different uses, that is, a pump, a compressor, a turbine, or a rotary internal combustion engine.

The rotary systems, on one hand, are centrifugal and continuous operating systems, having low vibrations and low noise, but, because their efficiency is centrifugal force dependent, which is rpm dependent in turn, suffers from the limitation that it falls at lower or higher to optimum rpm/s.

On the other hand, the reciprocatory systems of piston in the cylinder are positive displacement systems; they successfully work at lower and higher speeds, but show reducing performance-efficiency toward lower extremity due to their batch displacement phenomenon; while, toward the higher, vibrations set in the plateau.

There are numerous rotary engines listed, including that of Wankel, but till date they have gained only limited popularity, because for example, the Wankel engine has eccentric motion of the rotor, insufficient sealing ability of the apex seals, low fuel efficiency, and so their inability to meet pollution norms at higher rpm/s.

The present mechanism is continuous and rotary, and impels high torque even at low rpm as it does at higher ones, because it employs positive displacement mechanism.

None of the patents disclosed so far, harnesses the benefits of the natural mode of volume change, that is, volume change in all the three dimensions. This one does.

Neither it is an improvement over centrifugal systems because it uses none; nor, for the same reason, over reciprocating systems. Therefore, the chances of literature availability specifically pertaining to this concept in the prior art are dim.

It has many advantages. To list a few:

Advantage 1: It has concentric rotations of the discs.

Advantage 2: what piston does while reciprocating, it does while rotating.

Advantage 3: discs rotate but do not work on the principles of centrifugal force.

Advantage 4: it works on principle of positive displacement or compression of fluids.

Advantage 5: in the present illustration, in contrast to piston systems, it generates power on eight occasions in 720 degrees of rotation (once every 90°); so 100 cc engine will produce power of 800 cc engine. This is cited only as an example, and is not binding to the patent.

Advantage 6: kinetic energy is not lost when the breaks are applied to wheels. It is automatically transferred to other rotating parts of the engine and discs; and thus it is conserved for short periods of time; and is later, transferred back to wheels when the 200 breaks are released. The graph of energy conservation falls with duration of time lapse between application of breaks and their release; of course, during this lapse the throttle may be kept closed.

Advantage 7: The special breaking device eliminates the need for clutch device, but it would be inappropriate to call it breaking device, because breaking device consumes the motion of the wheels; contrarily, this device conserves it. It would, therefore, be appropriate to name it 'motion transferring device', instead.

Advantage 8: The actuation of 'motion transferring device' would give instantaneous result effortlessly, instead of a common time lag taken by present day breaking device.

Advantage 9: Possible to install the engine in the hub of the wheels instead of the bonnet or the frame of the two wheelers (hopes the dream comes true).

Advantage 10: has minimum number of moving parts.

Advantage 11: can be used as a pump, compressor, turbine and engine.

Advantage 12: The same engine can possess different compression and expansion ratios for optimum combination thereof to realize best thermal efficiency.

Other benefits and advantages will become apparent to those skilled in the art to which it pertains upon reading and understanding of the following detailed specification.

VI. BRIEF DESCRIPTION OF THE DRAWINGS

The invention may take physical form in certain parts and arrangement of parts, embodiments of which will be described in detail in this specification and illustrated in the accompanying drawings which form a part hereof and wherein:

FIG. 10 shows the detail view G in the 'cam' depicting the compressed-air-inlet-port and fuel injection port.

FIG. 11A shows the cam in elevation view.

FIG. 11B shows internal structure of the cam from another elevation view.

FIG. 11C shows the cam in a top view.

FIG. 11D shows the cam in a left side view.

FIG. 11E shows the cam in a front view.

FIG. 11F shows the cam in a right side view.

FIG. 18E shows a top view of a second disc having a staircase contour.

V. DETAILED DESCRIPTION OF THE INVENTION

Figure 1:
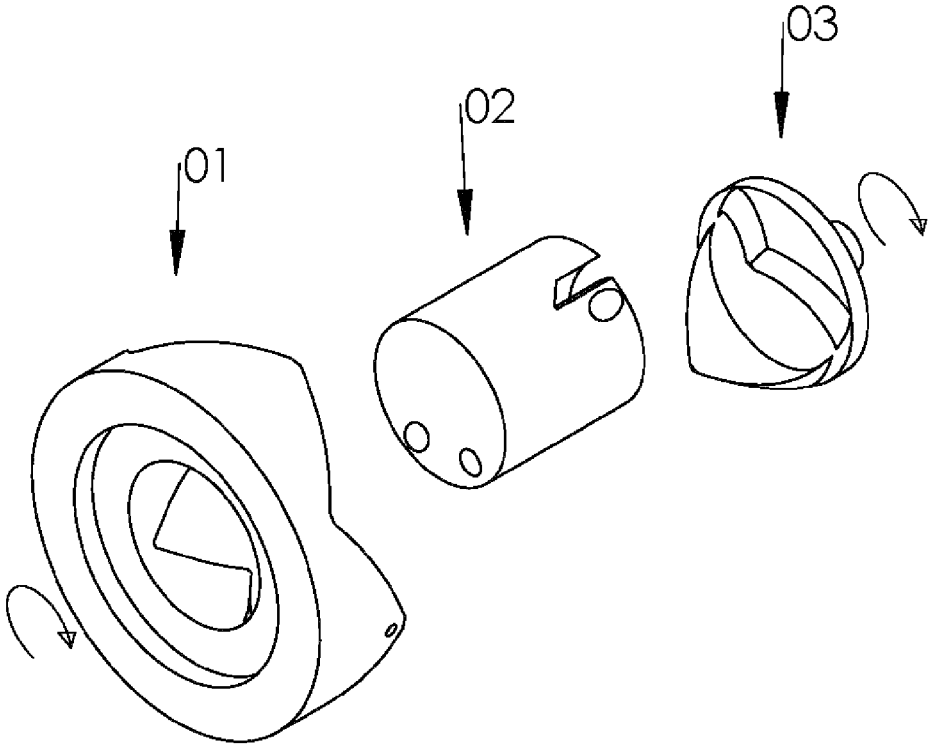
FIG. 1 is an exploded view of the three essential components of the 'rotary three dimensional variable volume machine' as per this invention.

The exploded view of FIG. 1 depicts the three essential components: first disc (01), the 'cam' (02) and the second disc (03).

In the first disc, a central hole (04) is shown for the placement of the 'cam'. The ball bearing housing is (05).

The 'cam' has a semi-circular slit into which slips the wall of the rotating second disc.

The second disc acts as a cap over the cavity formed under the area it covers on the face of the first disc.

Figure 2:
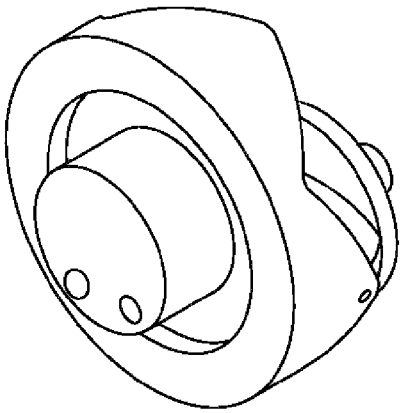
FIG. 2 shows the assembled view thereof.
Figure 3A:
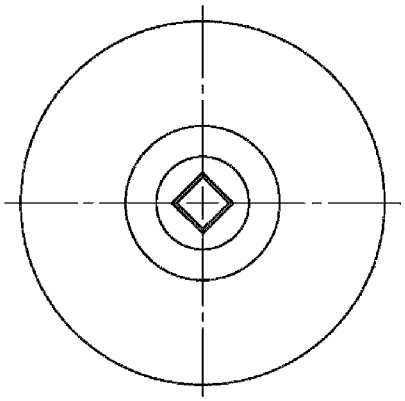
FIG. 3A shows the second disc in plan view.
Figure 3B:
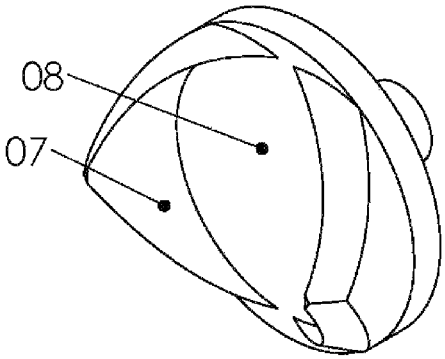
FIG. 3B shows the second disc in a elevation view.
Figure 3C:
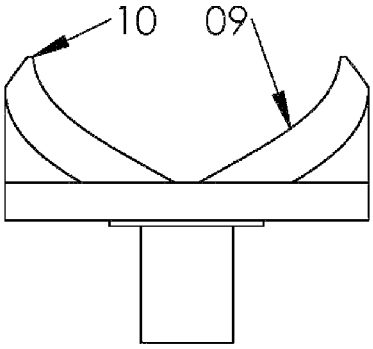
FIG. 3C shows the second disc in a side view.
Figure 3D:
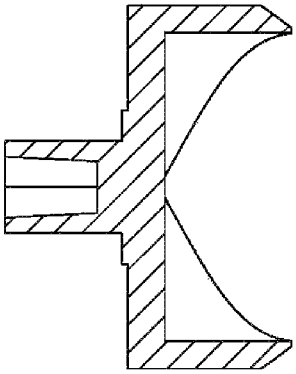
FIG. 3D shows the second disc in a side cross-sectional view.
Figure 3E:
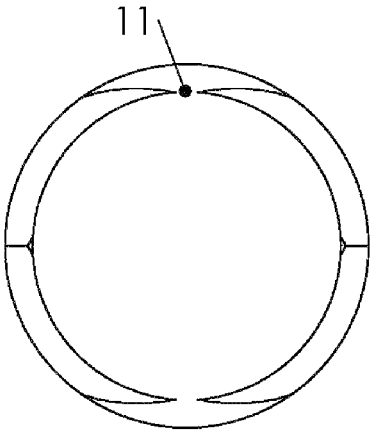
FIG. 3E shows the second disc in a top view.
Figure 3F:
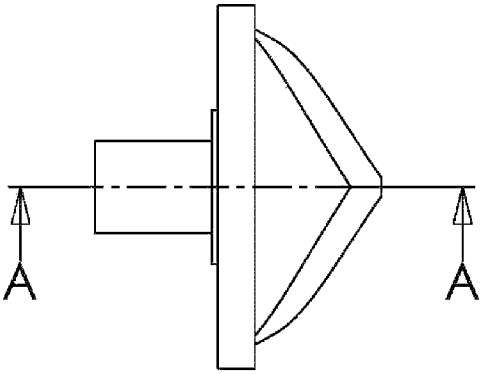
FIG. 3F shows the second disc in a side view.
Figure 4A:
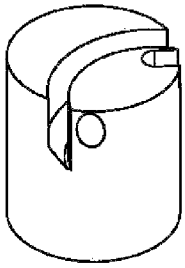
FIG. 4A shows the cam in an elevation view.
Figure 4B:
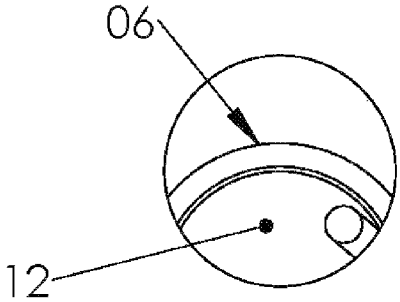
FIG. 4B shows the cam in a top view.
Figure 4C:
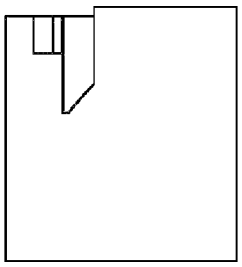
FIG. 4C shows the cam in a right side view.
Figure 4D:
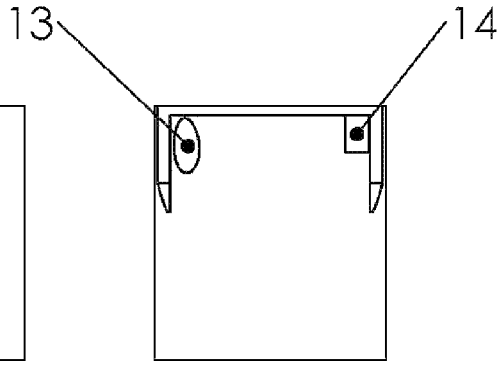
FIG. 4D shows the cam in a front view.
Figure 4E:
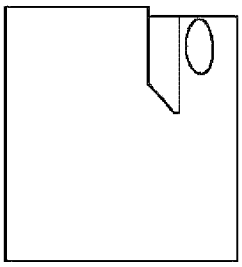
FIG. 4E shows the cam in a left side view.
Figure 4F:
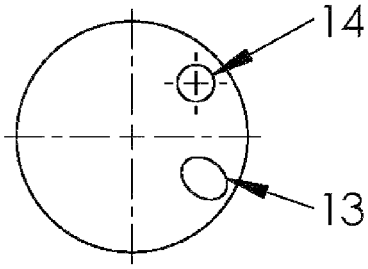
FIG. 4F shows the cam in a bottom view.
Figure 5A:
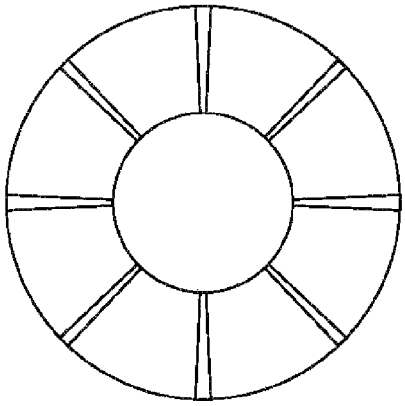
FIG. 5A shows the first disc in a top view.
Figure 5B:
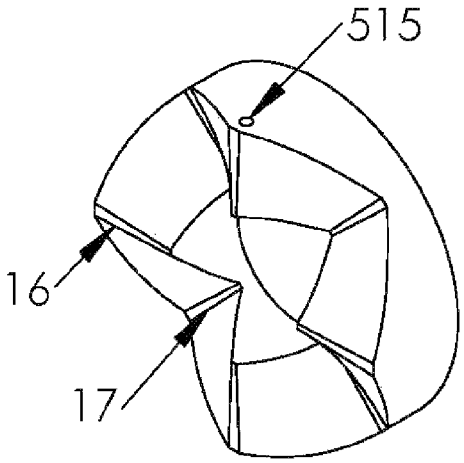
FIG. 5B shows the first disc in a elevation view.
Figure 5C:
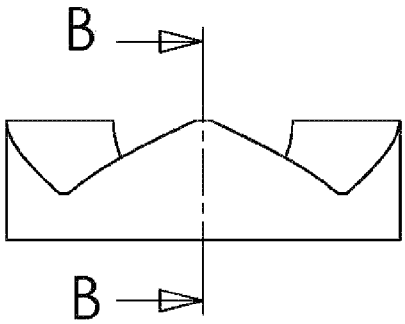
FIG. 5C shows the first disc in a side view.
Figure 5D:
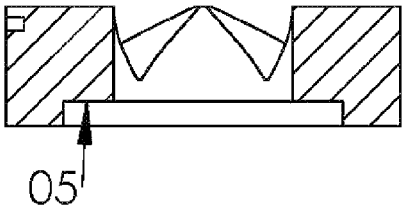
FIG. 5D shows the first disc in a side cross-sectional view.
Figure 5E:
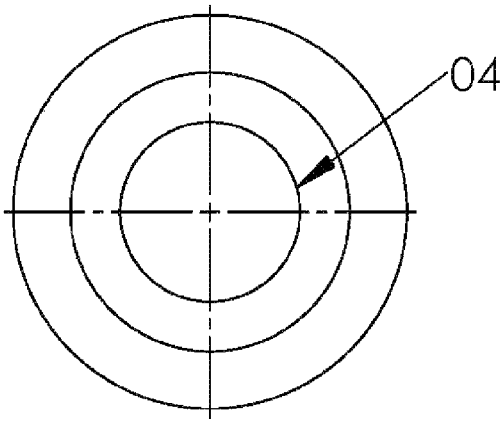
FIG. 5E shows the first disc in a bottom view.

FIG. 2 depicts the assembled view of the machine.

It shows the assembled view of the machine. Note that both the second disc and first disc have nonaligned axes of rotation.

FIGS. 3A-F show second disc as viewed from different angles.

The overall contour on the wall of the second disc will be, such that, one half the disc will appear a mirror image of the other half.

The perpendicular height of the tips of the inner wall (07) measured from the floor (08) will be 'X' units. It may be constructed out of a piece of seamless pipe whose one hole is closed and attached to a shaft in the center; while the other hole is left open for a peculiar contour on the wall of the pipe described as follows:

The circular wall of the pipe will be given two 'upward quarter helical cuts', both running upwards in opposite directions on the wall, and both beginning from the floor (08) of the closed end of the pipe at 0°, one cut rising toward 90° on the wall; while, the other, rising toward 270°, on the opposite side; and thereafter by giving two 'downward quarter helical cuts', from the top edge of both the thus formed tips, both falling toward 180°, one falling from 90° and the other from 270°.

Then, the outer walls edge of this disc will be filed on a predetermined angle to give a sharp edge (09) to the inner wall (07) all along contour thus formed.

The top most tips thus formed, are then filed down a few units to form blunt tips (10); and similarly, the bottom most tips on the inner wall are also filed apart the same units each, to form somewhat wider passage (11) for imparting strength and longer life to the second disc.

Alternatively, this filing operation of the tips and widening of the passage may not be performed during tool operation, depending upon whether we wish to keep the tips blunt, and bottom passages wide; or, we wish to keep top edges sharp and the bottom passage narrow; because, such blunt tips and wider passage will eventually be formed in normal course of friction when the contours of the two discs will mesh with each other during motion/s. When this will happen we may probably just need to tighten the two discs closer together.

FIGS. 4A-F show the 'cam' carrying the ports and passages for fluid movement as viewed from different angles.

The semi-circular slit (06) is clearly visible on the face (12) of the 'cam' and so are the inlet port (13) and outlet port (14). The semi-circular slit is so created in the 'cam' so that it permits the inner wall (07) of the second disc to just get poised on the central point of the first disc and the rest of the wall width of the second disc falls beyond this central point. The face (12) of the 'cam' having the semi-circular slit and facing the floor (08) of the second disc seals that portion of this floor it is in contact with.

FIGS. 5A-E show the first disc as viewed from different angles and one cross sectional view.

Note the ridges and furrows are 90° apart, each alternating with the other. Also, note that each diameter is placed at a uniform height except for the central hole; and that this is true to all the diameters of the first disc. The ridges and the furrows of the first disc have been filed to avoid extreme sharp edges for longer life of the first disc. Note the (optional) reference spot (515) for tracing the motion of the disc and also note the central hole (04) of a convenient size drilled in for the placement of the 'cam' in it.

As regards the overall look of the contour on first disc, half the disc will appear a mirror image of the other half. The front face of first disc has contour across and along the radii as follows:

The floor of the first disc will be 'X' units deep on 0°, 90°, 180° and 270° as measured from the top most radii. The radii 0°+1 °, 90°+1 °, 180°+1 °, 270°+1° will have disc height X+1 unit, and this will keep on increasing by unity, until, (X+45 units) is reached, the peak height is achieved at 45°, 135°, 225°, 315° of the first disc; and thereafter, this height will start falling in the same order it rose, to a depth of 'X' units on 90°, 180°, 270° and 0°. Thus, there will be top sharp ridges, and bottom narrow furrows, alternating each other, respectively.

The ridges and the furrows will then be filed to form blunt ridges (16) and wider furrows (17) instead of the sharp ones, to accommodate the width of the tips (10) and the wider passages (11) of second disc. This filing of the ridges and furrows will impart strength and longer life to the contours of the first disc.

Alternatively, this filing operation may not be performed during tool operation, depending upon whether we wish to keep the top ridges blunt, and bottom furrows wide; or we wish to keep top edges sharp and the bottom furrows narrow; because, such blunt edges and wider furrows will eventually result in normal course of friction between the contours of the two discs during motion/s.

The top of the ridges (16) and the face (12) of the 'cam' having the semi-circular slit (06) will have the same height as that of the floor (08) of second disc in the assembly so as to provide proper sealing to the compartment(s).

Figure 6A:
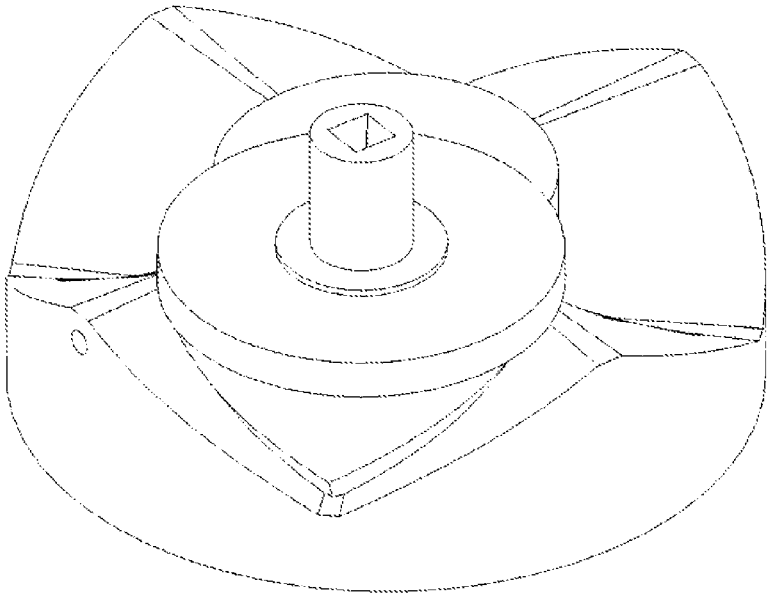
FIG. 6A shows the machine in a first position.
Figure 6B:
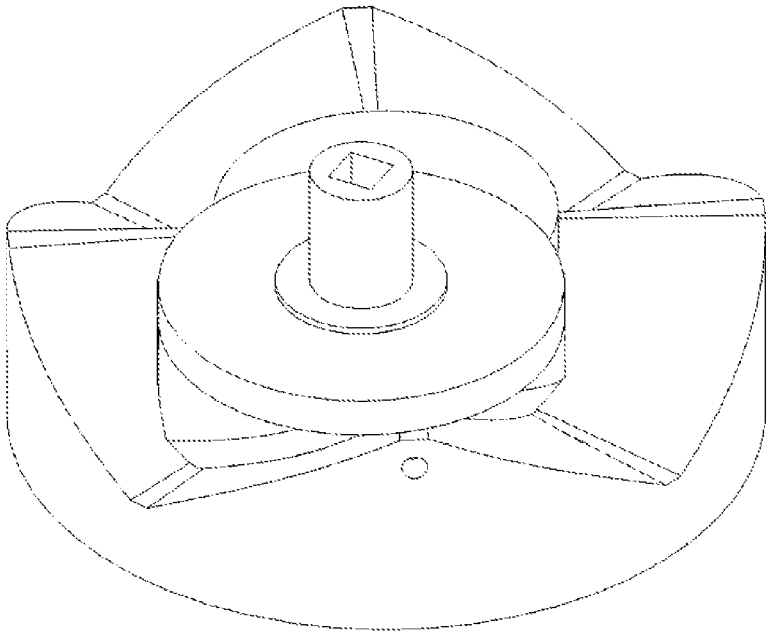
FIG. 6B shows the machine in a second position.

FIGS. 6A-B depict the assembly in motion. This explains how, the cavity underneath second disc gets divided into variable volume compartments when the ridge of first disc sweeps the floor (under surface) of second disc.

Both the discs are shown rotating in the anticlockwise direction. Note the reference spot on the side of ridge of the first disc in the two positions. The second disc is shown 'see-through'.

In position 1, the compartment to the left of the spotted ridge is very small. This is the intake compartment. The ridge has barely opened the inlet port of the 'cam'.

In position 2, the first disc has moved about 90°. Note the relative positional changes that have gone through among the contact surfaces of the two discs. Also note the positional changes relative to the two ports and the spotted ridge; in this position, after completely opening the inlet port, the spotted ridge has moved much to the right, and thus, the inlet compartment (the compartment to its left) has increased in its volume in all the three dimensions. Simultaneously, compartment to its right has closed much. This explains how, the cavity underneath second disc gets divided into variable volume compartments when the ridges of first disc sweep the floor (under surface) of second disc.

Figure 7:
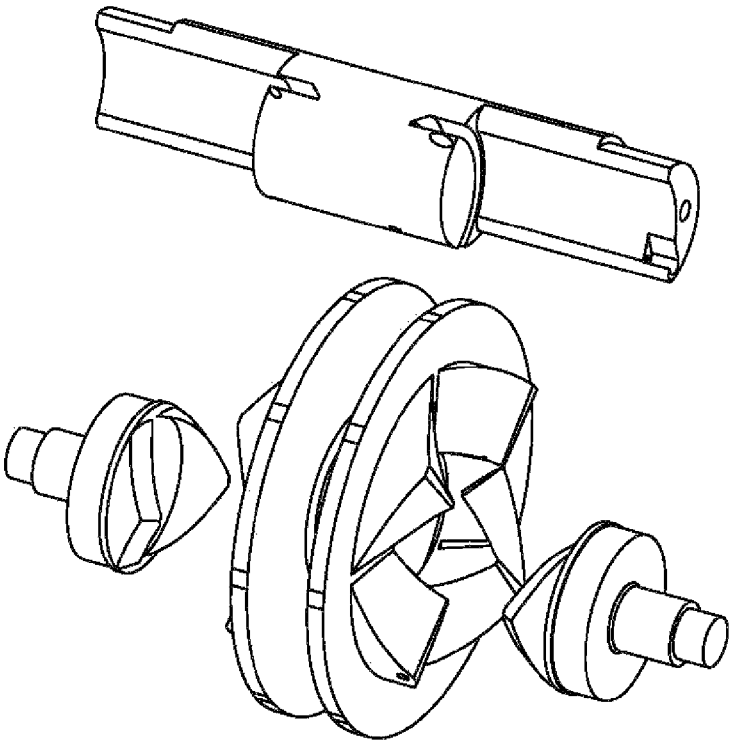
FIG. 7 shows the exploded view of the essential components of the 'rotary three dimensional variable volume internal combustion engine'; showing the 'engine cam' and two sets of first and second discs.

FIG. 7 is the exploded viewed of the machine.

It shows the exploded view of the machine. The 'cam' is shown as made of two pieces of 'cam' shown in FIGS. 4A-F, and joined in 'inverse repeat.' Similarly, two sets of first and second discs have been positioned as 'inverse repeat.'

Figure 8:
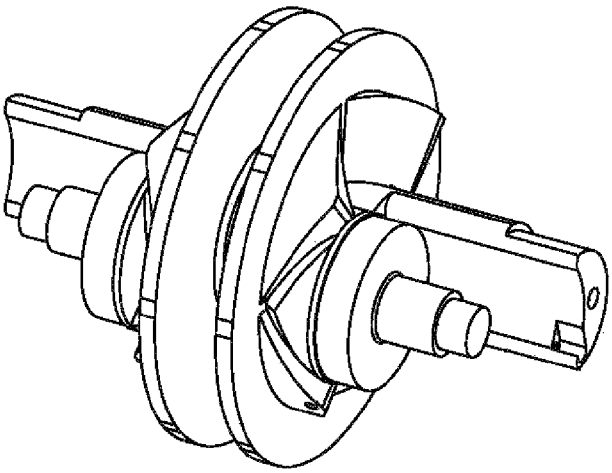
FIG. 8 shows the assembled view thereof, showing cold and hot sets of the first and second disc.

FIG. 8 shows the assembled view of the engine.

It shows the 'cam' pass through the central holes of the both the first discs. Half the portion, shown to the left of the figure, from the center is the cold set; while, the other half shown to the right of it, constitutes the hot set. Both these halves have been shown as if they have been joined as 'inverse repeats'

Figure 9A:
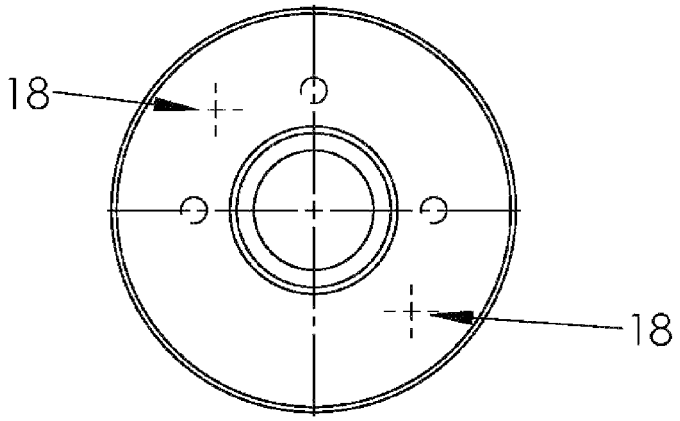
FIG. 9A shows a bottom view of the holes for screwing spark plugs in the second disc
Figure 9B:
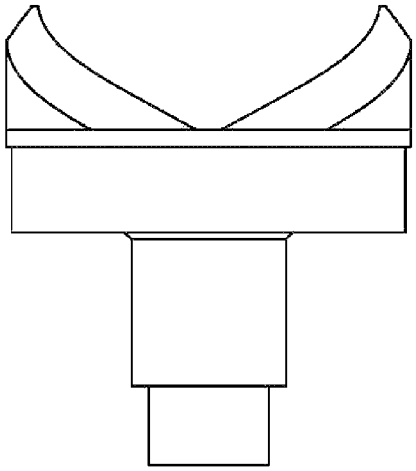
FIG. 9B shows a front view of the holes for screwing spark plugs in the second disc
Figure 9C:
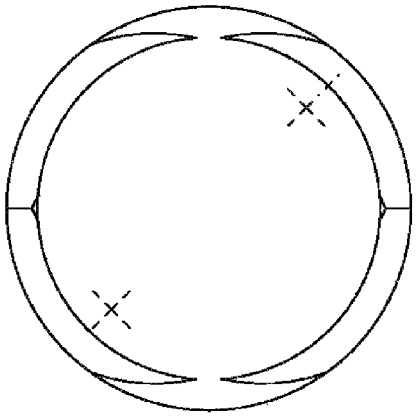
FIG. 9C shows a top view of the holes for screwing spark plugs in the second disc

FIGS. 9A-C show the second disc.

The pair of holes (18) depicted in the two views are for the spark plugs of petrol engine; these will be absent in diesel engine. Other description of second disc is identical as that in FIGS. 3A-F.

FIG. 10 shows the detail view G in the 'cam' of the rotary engine.

This figure shows the compressed-air-intake-port (1024) that opens into the combustion chamber of the hot compartment into which the compressed air from compression chamber of the cold set arrives via the unlinked crossing (29) shown in the top view.

FIGS. 11A-F show the 'cam' of the rotary engine.

In the front view of the 'cam,' on the left is seen the cold arm (1120) and on the right, the hot arm (1121). Running along the length of the 'cam', and passing through the unlinked cross at (29) are the fresh-air-passage and the used-air-exhaust-passage. On their ends, each has two openings (1122) and (1126), respectively. One shown in the front view, and another in the side. The openings in the side views are meant either to take-in fresh air, or to expel out the used and exhaust gases. These openings in the front view are named 'fresh-air-inlet-port' (1122) and used-air-exhaust-port (1126). The unlinked cross (29) of the passages in the center is important, because the cold arm of the 'cam', carries out the hot exhaust gases; while, the hot one, carries in the fresh air and keeps it cool. This tries to maintain uniform temperature of the two arms of the 'cam'.

Figure 12A:
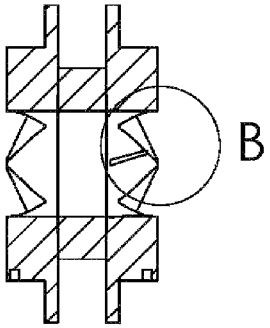
FIG. 12A is a cross-sectional view of the first disc.
Figure 12B:
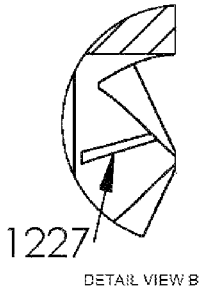
FIG. 12B is a close-up view of the conduit slid located in the hub of the first disc.
Figure 13A:
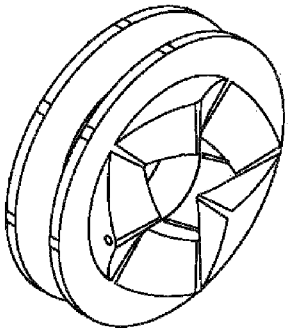
FIG. 13A shows the first disc in a first isometric elevation view.
Figure 13B:
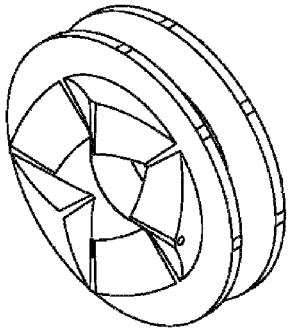
FIG. 13B shows the first disc in a second isometric elevation view.
Figure 13C:
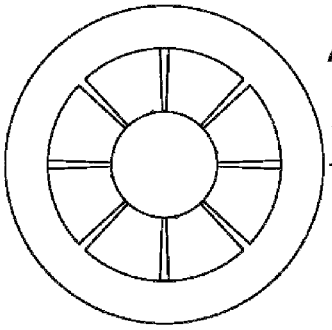
FIG. 13C shows the first disc in a right side view.
Figure 13D:
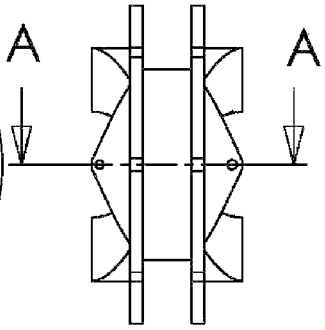
FIG. 13D shows the first disc in a front view.
Figure 13E:
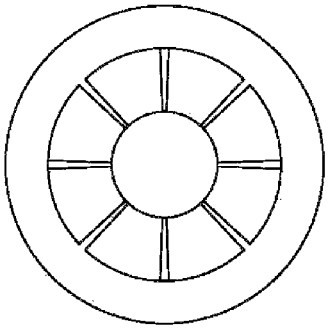
FIG. 13E shows the first disc in a left side view.

FIGS. 12A-B show the detail view B of the portion of the hub with the conduit slit (1227).

This conduit slit has a very important role to play. It acts as a conduit of compressed air into the combustion chamber when it connects the two ports, that is, compressed-air-exit-port (1123) in the cold set; and compressed-air-intake-port (1124) in the hot set.

FIGS. 13A-E show the two joined first discs as viewed from different angles and a sectional view A-A thereof.

Contour description of first discs is the same as that shown in FIGS. 5A-E.

Figure 14A:
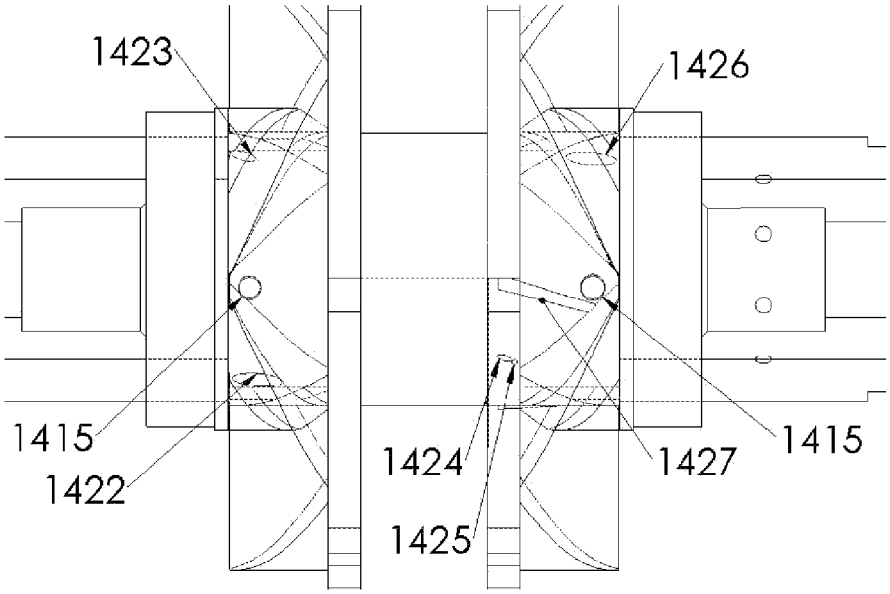
FIG. 14A shows a first of two positions of the engine in motion including internal structure.
Figure 14B:
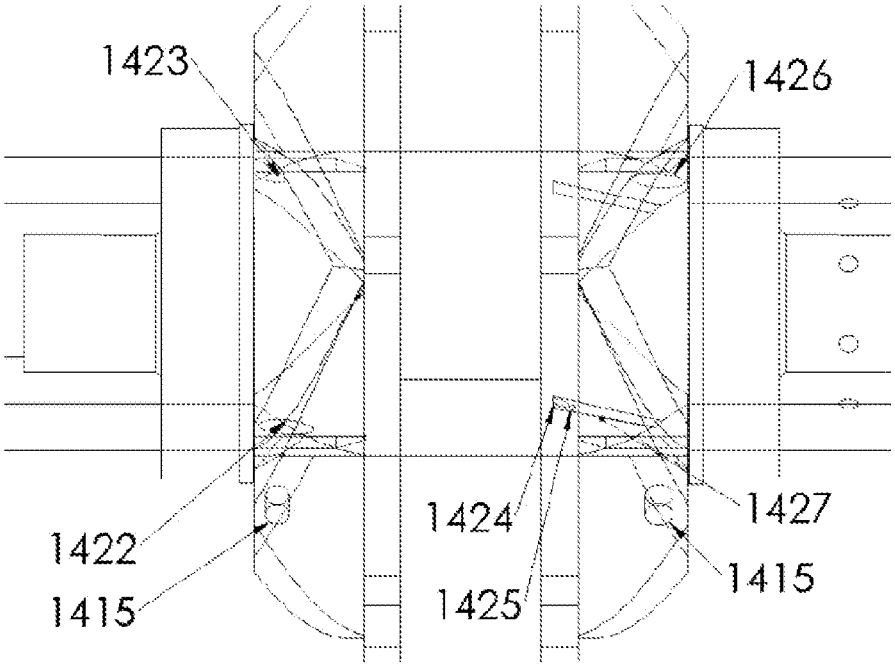
FIG. 14B shows a second of two positions of the engine in motion including internal structure.

FIGS. 14A-B show as to how the conduit slit (1427) in the hot set serves when the engine is in motion; two positions are shown. Note the reference spots (1415) on both the first discs.

Both the rotary sets are shown transparent, to reveal ports (1422, 1423, 1424, 1425, and 1426) located on the shown stationery 'cam'; and the conduit slit (1427) on the inside wall of the rotary hub of the first disc. The conduit slit changes position relative to the ports (1424 and 1425), as would the spotted ridge of first disc relative to the five ports under reference. Trace the motion of the discs by the reference spot (1415). In the two positions shown, the discs function as described in FIGS. 6A-B.

In position 1, the spotted ridge of the cold first disc near the compressed-air-exit-port (1423) has almost completely forced out the compressed air into the conduit slit (1427), but the air has not yet entered into the combustion chamber of the hot set, because the conduit slit (1427) has not yet connected to the Compressed-air-intake-port (1424).

The position 2, shows that the conduit-slit (1427) has established the connection first with the compressed-air-intake-port (1424) of the hot set so that the compressed air gushes into the combustion chamber, and after the process completes, disconnection occurs and then connection occurs to the fuel injection port (1425) in order to enable fuel injection into the combustion chamber. Thereafter, the disconnection again occurs as the hot set moves further up carrying the conduit-slit (1427) along, so as to permit safe ignition.

These sequential phenomena occur in a phased manner due to a noticeable slant in the conduit-slit; and needs actuation of no elaborate valve system.

Figure 15A:
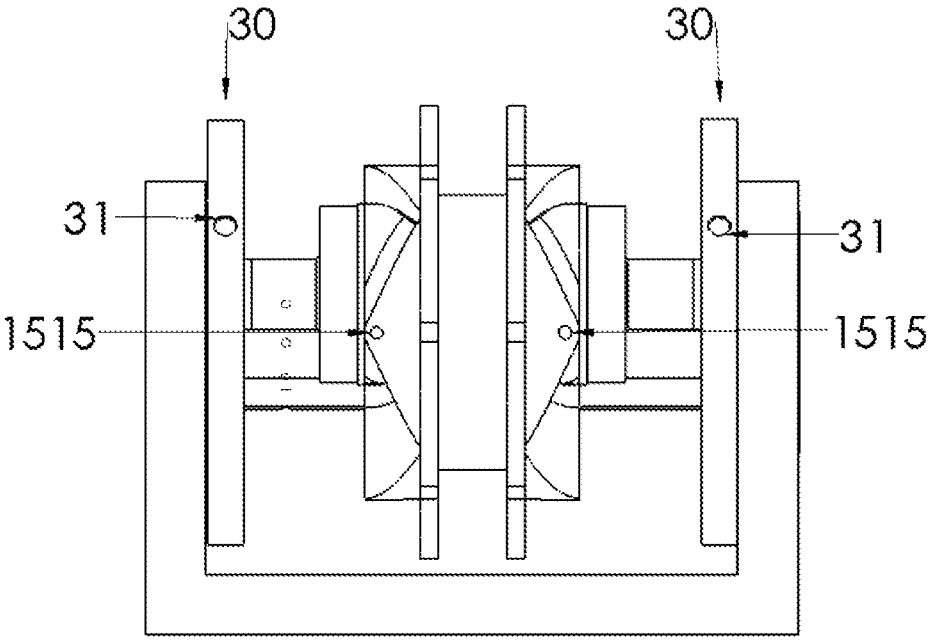
FIG. 15A shows the mechanism in a first position.
Figure 15B:
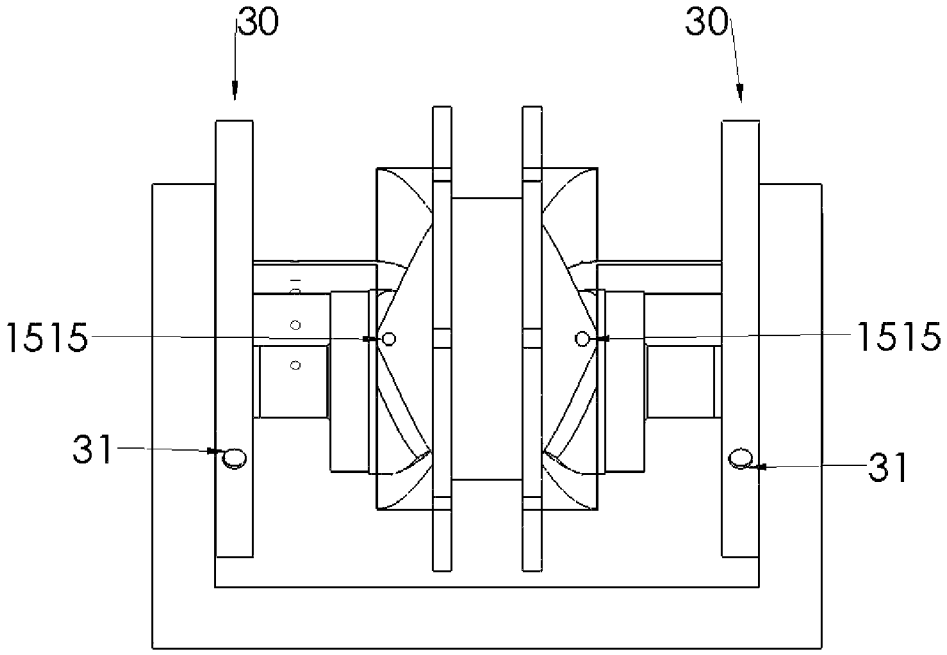
FIG. 15B shows the mechanism in a second position.
Figure 16A:
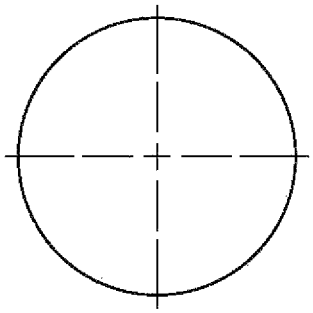
FIG. 16A shows a bottom view of a second disc having an upright ridge contour.
Figure 16B:
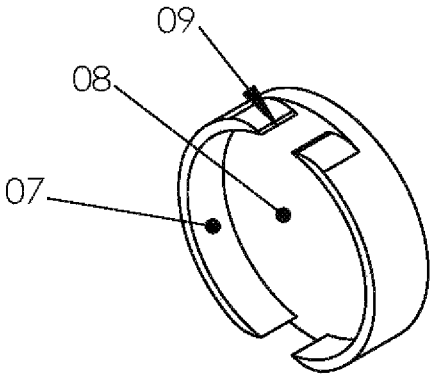
FIG. 16B shows an isometric elevation view of a second disc having an upright ridge contour.
Figure 16C:
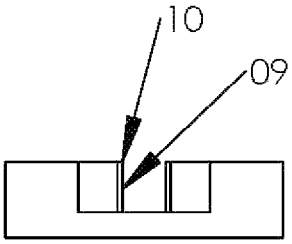
FIG. 16C shows a front view of a second disc having an upright ridge contour.
Figure 16D:
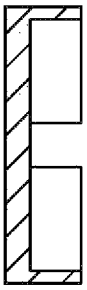
FIG. 16D shows a cross-sectional view of a second disc having an upright ridge contour.
Figure 16E:
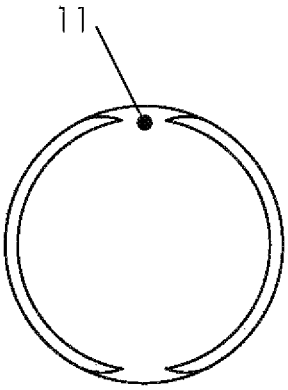
FIG. 16E shows a top view of a second disc having an upright ridge contour.
Figure 16F:
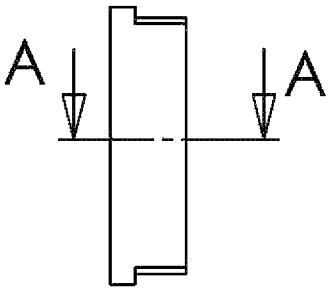
FIG. 16F shows a left side view of a second disc having an upright ridge contour.
Figure 17A:
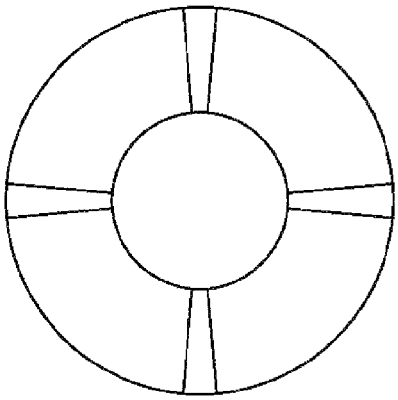
FIG. 17A shows a top view of a first disc having an upright ridge contour.
Figure 17B:
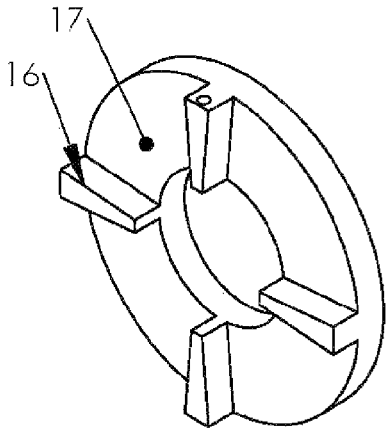
FIG. 17B shows an elevation view of a first disc having an upright ridge contour.
Figure 17C:
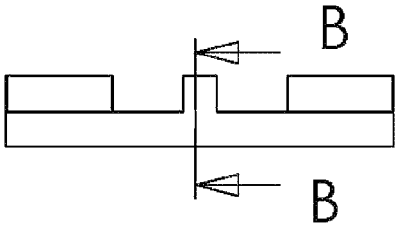
FIG. 17C shows a front view of a first disc having an upright ridge contour.
Figure 17D:
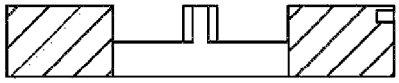
FIG. 17D shows a cross-sectional view of a first disc having an upright ridge contour.
Figure 17E:
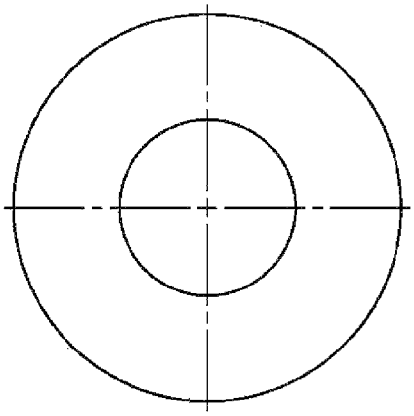
FIG. 17E shows a bottom view of a first disc having an upright ridge contour.
Figure 18A:
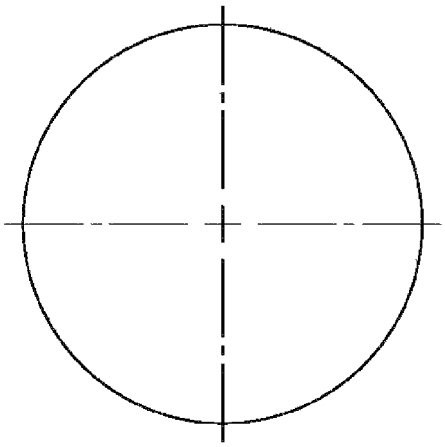
FIG. 18A shows a bottom view of a second disc having a staircase contour.
Figure 18B:
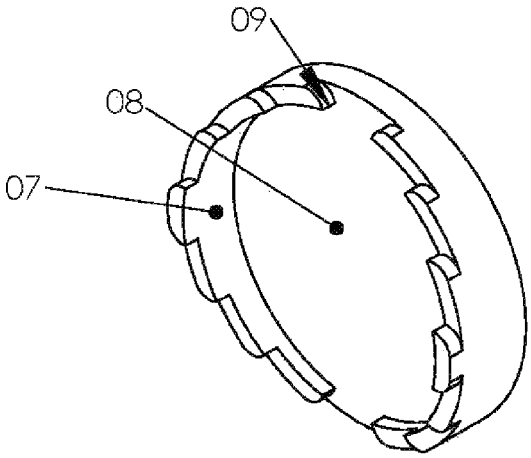
FIG. 18B shows an elevation view of a second disc having a staircase contour.
Figure 18C:
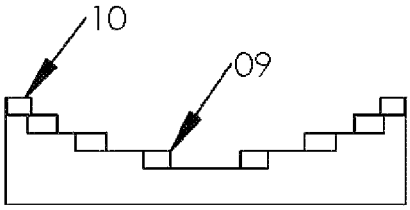
FIG. 18C shows a front view of a second disc having a staircase contour.
Figure 18D:
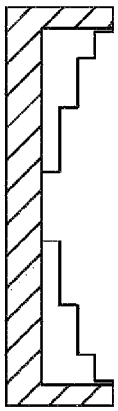
FIG. 18D shows a cross-sectional view of a second disc having a staircase contour.
Figure 18D:
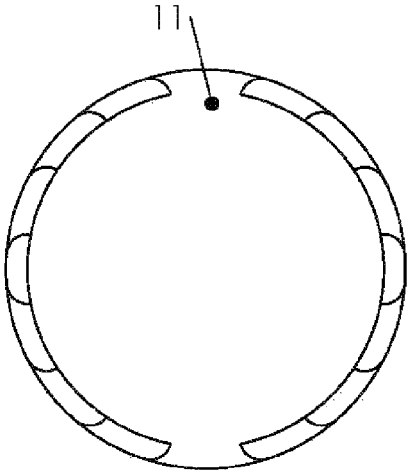
Figure 18F:
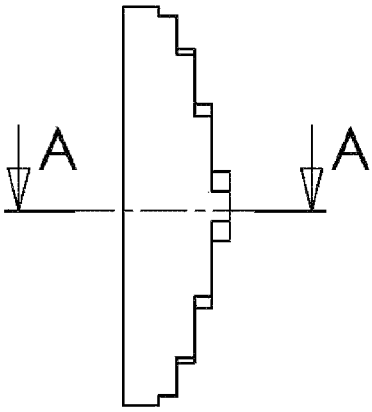
FIG. 18F shows a left side view of a second disc having a staircase contour.
Figure 19A:
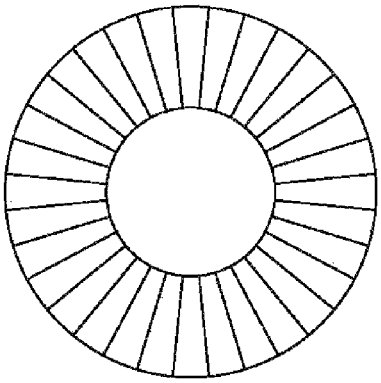
FIG. 19A shows a top view of a first disc having a staircase contour.
Figure 19B:
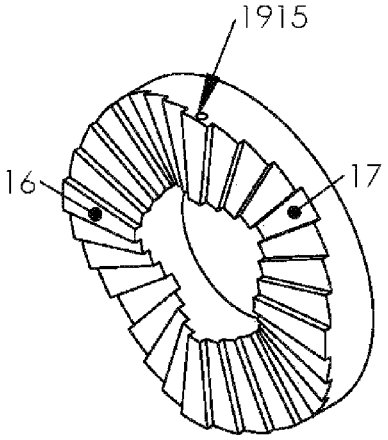
FIG. 19B shows an elevation view of a first disc having a staircase contour.
Figure 19C:
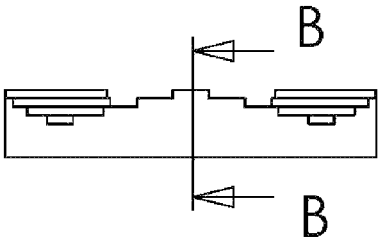
FIG. 19C shows a front view of a first disc having a staircase contour.
Figure 19D:
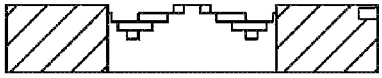
FIG. 19D shows a cross-sectional view of a first disc having a staircase contour.
Figure 19E:
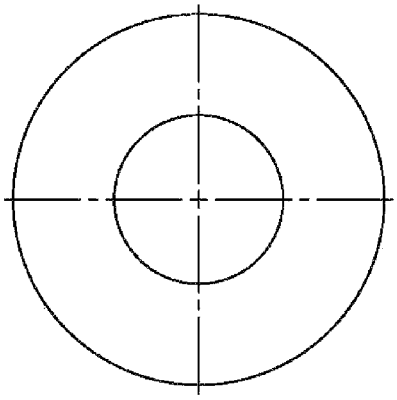
FIG. 19E shows a bottom view of a first disc having a staircase contour.

FIGS. 15A-B facilitate the revolution of second discs when the 'motion transfer device' applies to the first discs.

It depicts the mechanism facilitating the revolution of second discs when the 'motion transfer device' applies to the first discs. Then simultaneous to rotation of second discs, the third discs (30) and the 'cam' also rotate. The reference spots (1515) on hot and cold first discs are stationary; while the reference spots (31) on the pair of third discs is shown to have moved by degrees.

This ability of making revolutions of the pair of second discs is provided by the rotation of the pair of third discs, to which second discs are attached via a rotary shaft, attached to the back of second disc, on a point off-centered on the radius of third discs, at a distance equal to the radius of second disc, measured on its internal wall.

The stoppage of the first discs is made possible by the actuation of the 'motion transfer device' so designed that they will apply, at a time, either to the first disc or the third disc, leaving the remaining parts free.

The action of stopping first discs will result into transfer of its kinetic energy to the parts of the engine that will eventually be thrown into motion as a response, thus, instead of resulting into a loss of major segment of its kinetic energy (as happens in present day systems), it would rather be conserved, requiring no/little throttling initially, when shortly thereafter vice-versa occurs; thereby, increasing the efficiency of the engine, and probably, obliterating the need of the clutch system, altogether.

In addition to the foregoing contour types, embodiments may have less complex contours, which may be amenable to being manufactured with more precision. One example a simplified contour is an upright ridge type as shown in FIGS. 16A-F and FIGS. 17A-E. FIGS. 16A-F illustrate a second disc having an upright ridge contour. Reference number (09) of FIGS. 16A-F indicate that the edge of the second disc may be rounded off to improve the durability of the disc. FIGS. 17A-E illustrates a first disc having a shape which complements that of the second disc shown in FIGS. 16A-F. It too may have its edges rounded off to improve durability.

Another simplified contour is the semi-circular staircase type illustrated in FIGS. 18A-F and FIGS. 19A-E. FIGS. 18A-F shows a second disc having a semi-circular staircase contour. As shown in FIGS. 18A-F, reference numeral (09) indicates that the edges of the second disc may be rounded off to improve durability. Similarly, FIGS. 19A-E illustrate a first disc having a shape which complements that of the second disc shown in FIGS. 18A-F. It too may have its edges rounded off to improve durability.

The simplified contours shown in FIGS. 16-19 may have improved sealability due to being machinable to a higher degree of precision. Improved machinability may arise from the fact that the profiles of these components include no complex slopes. Furthermore, the edges of the second discs illustrated in FIGS. 16 and 18 are disposed in a safer position, namely, inward and on the sides of the way rather than in front. Consequently, the edges as well as persons handling these discs will be safer, and the edges will be less prone to damage in transport and handling.

Example 1

When is Used as Rotary Pump, Compressor or Turbine

This machine is capable of dividing the entire non-linear-cavity of second discs between the pairs of second discs (03)

and first discs (01) into compartments capable of varying in volume in all the three dimensions during the circular motions of the two discs. This is made possible by special contours designed on their faces that face each other. These compartments are named suction compartment on the left side of the reference ridge; and expulsion compartment on the right side of the reference ridge for suction and expulsion of fluid simultaneously, when used as pump, compressor or turbine.

Example 2

When the Invention is Used as Rotary Internal Combustion Engine

As regards rotary internal combustion engine, the concept utilizes, essentially, eight components working together in pairs when joined in inverse repeat (including the 'cam'), of the basic model 1. Two second discs,
2. Two discs first discs,
two discs third discs: and
3. A 'cam' to be placed in the central hole (4) of the first disc extending some of its portion inside the pair of second discs, reaching up to their floors.

The complementary discs make two dependent sets, one each of a pair of first and second discs.

One is the cold set. The non-linear cavity in the cold set gets divided on either side of the sweeping reference ridge into the 'intake' and 'compression' compartments, respectively, each for the intake and compression of fresh air, simultaneously and continuously. Considering any one compartment, at one time, it functions either as intake compartment, or at other, as compression compartment, alternately.

The other is the hot set. Similarly, the non-linear cavity in the hot set gets divided on either side of the sweeping reference ridge into the 'power' and 'exhaust' compartments, respectively, each for the power and exhaust strokes, simultaneously and continuously. Considering any one compartment, at one time, it functions either as power stroke compartment, or at other, as exhaust stroke compartment, alternately.

The passages in the 'cam' between the compression and combustion compartments gets inter-connected, just prior to ignition, for transfer of compressed air from the compression compartment into the combustion chamber, when the conduit slit (27) situated on the inner surface of hub of first disc, aligns with the ports situated on the 'cam', and for charging it with fuel through the fuel injection port in stepwise manner. The link remains disconnected during compression stroke and gets connected momentarily and gets disconnected thereafter, and remains so, just prior to ignition of the power stroke and during exhaust stroke, as the conduit slit situated on the hot first disc moves further away of the port situated on the 'cam'. Only a 'slant' of the slit does the job; and needs actuation of no valves.

This 'cam' carries the necessary ports and passages for bringing the fluid into the cavity or for forcing it out.

This is made possible by the changing volume of the compartments. The volume increases in the suction compartment on one side of the ridge creating partial vacuum, thus sucking the fluid inside, and simultaneously, decreases the volume of the expulsion compartment on the other side of the ridge, thus, increasing pressure on the fluid and forcing it out.

This machine may be used as a pump; as a compressor; or as a turbine for producing electricity; or for doing other kinds work needing rotations; or as a rotary internal combustion engine.

When the fourth component third disc is incorporated, it facilitates the revolutions of the second disc in addition to its rotations. Of course, each use is possible only after necessary modifications to this basic machine and after adding supporting components to it.

INDUSTRIAL APPLICABILITY

The invention will be put to application for all the four broad types of uses, that is a pump, a compressor, a turbine of all kinds and a rotary internal combustion engine with numerous advantages some of which are listed herein.

REFERENCE NUMBER LIST first disc (01)
the 'cam' (02)
The second disc (03)
central hole (04)
Ball bearing housing (05)
semi-circular slit (06)
the inner wall (07)
the floor (08)
a sharp edge (09)
blunt tips (10)
wider passage (11)
The face (12)
Inlet port (13)
Outlet port (14)
reference spot (15) on first disc
blunt ridges (16)
wider furrows (17)
holes for spark plugs (18)
cold arm (20)
the hot arm (21)
Fresh-air-intake-port (22)
compressed-air-exit-port (23)
Compressed-air-intake-port (24)
Fuel injection port (25)
The exhaust port (26)
The conduit slit (27)
open-to-air-inlet-port (28)
unlinked crossing (29)
third discs (30)
reference spot (31) on third disc It will be apparent to those skilled in the art that the above methods and apparatuses may be changed or modified without departing from the general scope of the invention. The invention is intended to include all such modifications and alterations insofar as they come within the scope of the appended claims or the equivalents thereof.

Having thus described the invention, it is now claimed:

1. A machine, comprising:

a first rotary disc (01) and a second rotary disc (03), wherein the first rotary disc (01) comprises a surface with ridges and furrows, wherein the second rotary disc (03) comprises a wall (07) with a shape complementary to the ridges and furrows of the first disc;

a central hole (04) in the first rotary disc;

a rotary cam (02) disposed in the central hole (04) of the first disc (01) and the rotary cam (02) comprising an inlet port (13) and an outlet port (14), and the rotary cam further comprising a semicircular slit (06) adapted to receive the wall (07) of the second rotary disc (03) allowing the wall (07) to slip through the semicircular slit while pressing against the surface of the first rotary disc's ridges and furrows to simultaneously form a suction compartment communicating with the inlet port and an expulsion compartment communicating with the outlet port between the first rotary disc (01) and the second rotary disc (03), and continuously maintain the suction compartment and expulsion compartment throughout a revolution of the second disc, wherein the first rotary disc and the second rotary disc are adapted to rotate simultaneously while the rotary cam is stationary the adaptation being capable of increasing the volume of the suction compartment and decreasing the volume of the expulsion compartment, wherein the second rotary disc and the rotary cam are adapted to rotate while the first rotary disc is stationary and the adaptation being capable of increasing the volume of the suction compartment and decreasing the volume of the expulsion compartment, and wherein the semi-circular slit is formed in such a way that the wall (07) of the second rotary disc (03) falls on the center of the first rotary disc (01).

2. The machine according to claim 1, wherein the surface of the first rotary disc with ridges and furrows defines a shape selected from one or more of a helical cut, an upright ridge, or a staircase.

* * * * *